United States Patent [19]

Zetlin

[11] 3,971,181

[45] July 27, 1976

[54] BEAMLESS FLOOR AND ROOF STRUCTURE

[76] Inventor: Lev Zetlin, 89 Hamilton Drive, Roslyn, N.Y. 11576

[22] Filed: Apr. 4, 1974

[21] Appl. No.: 457,982

[52] U.S. Cl. ..... 52/263; 52/283; 52/392; 52/592

[51] Int. Cl.[2] ..... E04B 5/08

[58] Field of Search ..... 52/263, 73, 745, 262, 52/236, 283, 592, 390, 391, 392

[56] References Cited

UNITED STATES PATENTS

| | | | |
|---|---|---|---|
| 1,685,244 | 9/1928 | Rosenzwerg | 52/743 |
| 3,354,593 | 11/1967 | Zukas | 52/73 X |
| 3,460,446 | 8/1969 | Finsterwalder et al. | 52/263 X |
| 3,530,626 | 9/1970 | Mezes | 52/262 X |

FOREIGN PATENTS OR APPLICATIONS

| | | | |
|---|---|---|---|
| 141,321 | 8/1949 | Australia | 52/390 |
| 164,118 | 8/1946 | Austria | 52/593 |
| 176,004 | 9/1953 | Austria | 52/390 |
| 110,920 | 5/1964 | Czechoslovakia | 52/263 |
| 53,287 | 1/1967 | Germany | 52/236 |
| 836,707 | 5/1952 | Germany | 52/236 |
| 312,867 | 11/1933 | Italy | 52/390 |
| 6,950 | 2/1922 | Netherlands | 52/263 |
| 118,578 | 1/1970 | Norway | 52/592 |
| 42,958 | 3/1960 | Poland | 52/236 |
| 149,634 | 12/1931 | Switzerland | 52/390 |
| 248,829 | 3/1926 | United Kingdom | 52/592 |
| 670,646 | 4/1952 | United Kingdom | 52/390 |

*Primary Examiner*—Frank L. Abbott
*Assistant Examiner*—Leslie A. Braun
*Attorney, Agent, or Firm*—Henry Sternberg

[57] ABSTRACT

A beamless load bearing surface or stratum having a first group of polygonal plate members forming a peripheral ring. Each of such plate members forming such ring having a transverse edge supported on a longitudinal edge of the next adjacent plate member and so on around the ring. A second group of these plate members forms a second ring interiorly of the first ring. Each of the plate members in the second ring also having a transverse edge supported on a longitudinal edge of the next adjacent plate member of such second ring. In addition, each of the plate members in the second ring is supported along one of its longitudinal edges on the longitudinal edge of an adjacent one of the plates of the peripheral ring. Additional such rings inwardly of the second ring may be provided as desired as may also a central plate member for closing the opening left by the innermost such ring.

16 Claims, 7 Drawing Figures

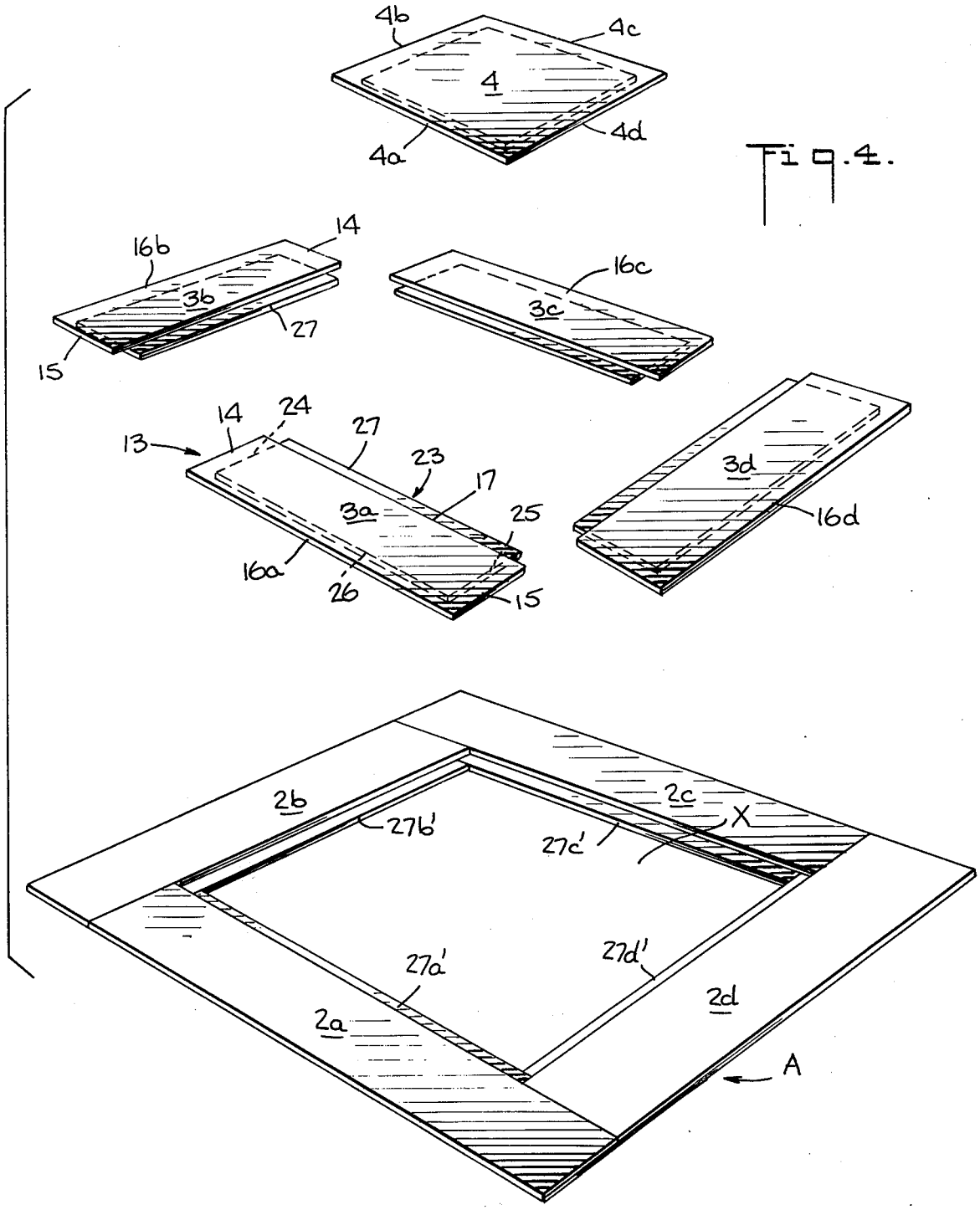
Fig. 4.
Fig. 3.
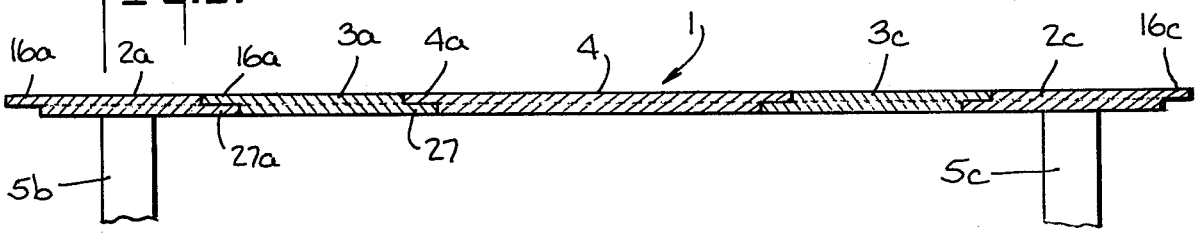

BEAMLESS FLOOR AND ROOF STRUCTURE

FIELD OF THE INVENTION

This invention relates to a system of construction for beamless structures and aims at simplicity, ease of construction and resulting economies.

In particular, the present invention relates to a floor and/or roof structure of modular plate elements which serve not only to form the floor and/or roof stratum, but also to support one another so as to eliminate both the need for beams and for interior support columns.

In accordance with the present invention, there is provided a structural system comprising a plurality of plates supported by and, in turn, supporting adjacent plates without the aid of beams of any sort. The plates can be precast in the factory and transported to the building site or can be precast on the site.

The invention consists specifically of a system of building construction for beamless structures such as for use as a roof and/or a floor.

DESCRIPTION OF THE PRIOR ART

According to present construction methods, load bearing surfaces such as floors comprise either a large number of interior supports, such as vertical columns, spaced throughout the area to be covered by the surface, or if fewer such columns are used, then horizontal beams supported on the columns with the flooring supported on and extending between parallel ones of such beams.

While such beam systems can be used to cover large surface areas without interior vertical columns obstructing the next lower level, such systems are relatively complex and expensive in that they require many different types of component members which must be assembled together at the building site.

Beamless building construction, per se, is known and is, for example, shown in the patent to Zukas, U.S. Pat. No. 3,354,593. According to the known construction, each of a plurality of vertical columns supports a cantilever slab. The spaces between these cantilever slabs are then covered by so-called "bridging slabs" which span the distances between adjacent ones of the cantilever slabs. The remaining central opening is then covered by a so-called "in-filling slab." The system described by Zukas requires the infilling slab to be supported solely by the bridging slabs which latter are each supported solely by a pair of the cantilever slabs. Each cantilever slab is supported solely by its own corresponding vertical column. Since, however, the slab size is limited both by the size of available lifting apparatus at the building site and the size which can be readily transported from the factory where the slabs are prefabricated, the individual slabs cannot be excessively large. Thus, since following the Zukas teaching, it is possible to have only a single bridging slab spanning the distance between adjacent cantilever slabs, i.e., between adjacent vertical columns, there are necessarily required a relatively large number of vertical support columns for floors and/or roofs of any substantial area.

For these and other reasons it has long been an objective to develop a beamless floor and/or roof structure capable of covering large areas and capable of bearing substantial loads while requiring only a minimum number of vertical supports.

It is thus an object of the present invention to provide a floor and/or roof structure of the type described which is comprised entirely of prefabricated modular elements which, while they may have varying dimensions, are generally of the same shape.

A further object of the present invention is to provide modular elements or plate members of the above type which are capable of being assembled together, on site, without beams, into a floor and/or roof structure of relatively large area and which require only a minimum of peripherally located supports and no interior supports.

A concomitant object of the present invention is to provide prefabricated modular components specially suited for use in a floor and/or roof structure such as described.

It will be seen that in accordance with the present invention, a beamless floor and/or roof structure of substantial area can be economically constructed with a minimum number of vertical support columns, yet the size of individual plates can be kept sufficiently small so that they may be easily transported to the site and easily lifted and maneuvered at the site. Thus, while the Zukas construction finds its greatest utility with respect to structures of moderate size (i.e. where the spacing of the columns is between "approximately 12 to 16 feet"), the construction according to the present invention finds its greatest utility in structures having relatively larger floor areas in which the spacing of the columns may be say from 12 to 60 feet.

SUMMARY OF THE INVENTION

Generally speaking, the objectives of the present invention are attained by the provision of a beamless, load-bearing, stratum having a relatively large unsupported area and supported only at its periphery preferably by a plurality of vertical support columns. According to the invention, the beamless structure is formed of a plurality of concentric rings (as used herein the term "ring" is intended to describe any closed polygonal figure such as a square, rectangle, triangle, etc.), each comprised of a group of elongated, prefabricated, horizontally disposed, modular plates which fit together to form the ring structure. Only the outermost one of the concentric ring structures is supported by the columns. The plates in each ring are aligned in end to edge relationship. Each plate of the outermost ring is supported at one end by a corresponding one of the vertical columns and arranged so that one of its edges faces toward the center of the ring. The opposite end of each plate extends toward, but does not reach, the next succeeding column (when viewed in one direction — but not in the other — around the ring) and is supported by the inwardly facing edge of the plate supported by such next succeeding column. Each inner ring is also formed by plates in similar end to edge relation. The plates of each inner ring support each other as described above, but instead of being also supported by columns — as is the case with the plates of the outer ring — the plates of each inner ring are supported by the next adjacent outer ring, and, in turn, support the next adjacent inner ring. Thus, no columns are required for supporting the rings which are interior to the outermost ring.

Preferably, the structure according to the present invention will be used to form a horizontal stratum such as a horizontal floor and/or a horizontal roof.

BRIEF DESCRIPTION OF THE DRAWINGS

The foregoing and other objects and features of the present invention will be more clearly understood from the following detailed description thereof when read in conjunction with the accompanying drawings, in which:

FIG. 3 is a cross-sectional view of the structure of FIG. 2 taken along line 3—3 of FIG. 2;

FIG. 4 is a partially exploded perspective view of the stratum illustrated in FIG. 1, showing the outer ring-forming elements in position forming the outer ring and the inner ring forming elements and central plate member in exploded condition;

DESCRIPTION OF THE PREFERRED EMBODIMENT

Figure 1:
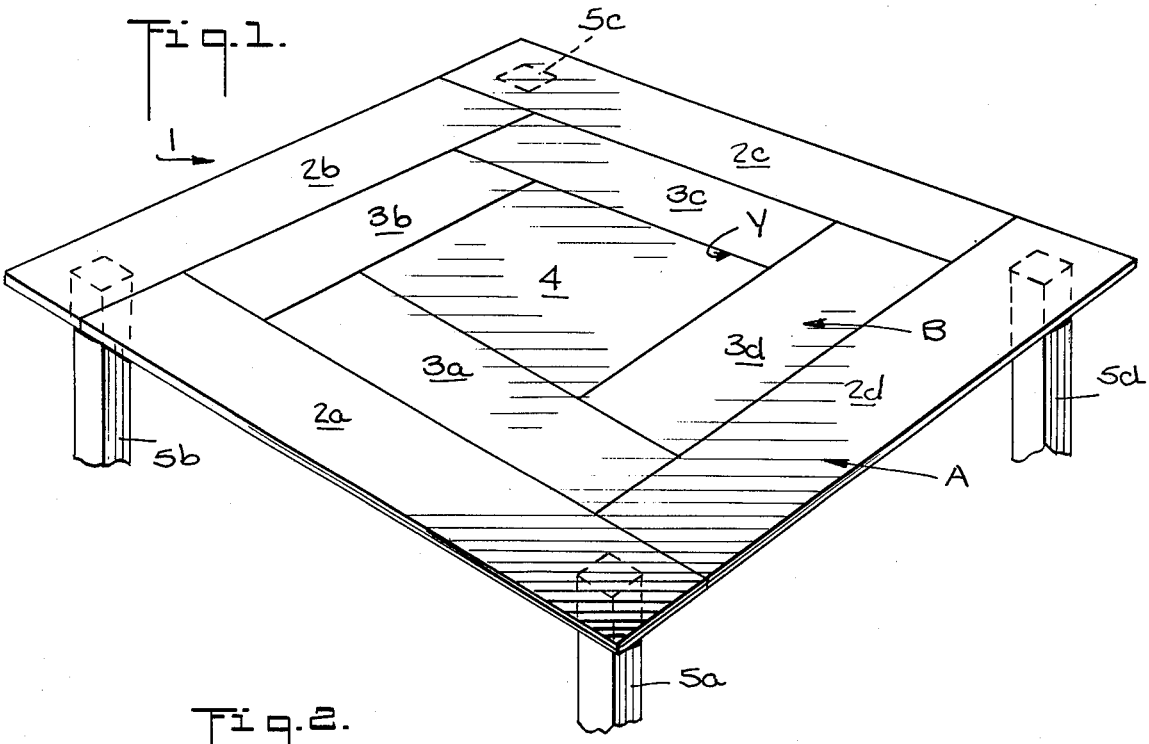
FIG. 1 is a perspective view of a floor structure according to the preferred embodiment of the present invention showing an outer ring of plate elements supported on vertical columns, an adjacent inner ring of plate elements supported by said outer ring and a central plate member supported by said inner ring.

Turning now to FIG. 1, there is illustrated a preferred embodiment of the invention, namely, a load bearing floor structure of stratum 1 having a rectangular configuration. In its simplest form the structure is made up of two rings, "A" and "B", comprised of a plurality of prefabricated modular plates, 2*a*, 2*b*, 2*c*, 2*d*, and 3*a*, 3*b*, 3*c*, 3*d*, respectively, and a central plate member 4. The outer ring "A" of surface 1 is supported on four vertical support columns, 5*a*, 5*b*, 5*c*, 5*d*, located respectively in the region of the corners of the rectangle. Each of the plates 2*a*, 2*b*, 2*c*, 2*d*, is supported at one end thereof by a respective one of the columns 5*a*, 5*b*, 5*c*, 5*d*, and extends with its other end toward, but does not reach, the next succeeding column (in clockwise direction), so that such other end of each of the plates 2*a*, 2*b*, 2*c*, 2*d*, rests on and is supported by the next succeeding plate in ring "A" (in clockwise direction). Thus, plate 2*a* is supported at one end by column 5a and at the other end by plate 2*b* and so on around ring "A". The plates 2*a*, 2*b*, 2*c*, 2*d* and 3*a*, 3*b*, 3*c*, 3*d*, are preferably rectangular in shape. While, according to the preferred embodiment, the plates 2*a*, 2*b*, 2*c*, 2*d* and 3*a*, 3*b*, etc., are unitary in construction, they may be of laminated construction, i.e. formed of a pair of flat slab members integrally connected with one another. For ease of explanation, the plate members 2 and 3 will now be considered as comprised of an upper and a lower slab laminated together. Since all of the plates 2 (i.e. 2*a*, 2*b*, 2*c*, and 2*d*) and all of the plates 3 (i.e. 3*a*, 3*b*, 3*c* and 3*d*) are of identical construction (though plates 2 and 3 are of different size), it will suffice to describe just one plate member. Plate 3*a*, for example, comprises an upper rectangular flat slab 13 and a lower rectangular flat slab 23. Upper slab 13 extends at its opposite transverse ends 14 and 15, beyond the corresponding transverse ends 24 and 25 of lower slab 23 and extends, along one longitudinal edge 16 thereof, beyond the corresponding longitudinal edge 26 of the lower slab 23. The other longitudinal edge 27 of the lower slab 23 extends beyond the corresponding other longitudinal edge 17 of the upper slab 13. The longitudinal edges of the lower slab are preferably parallel to the corresponding longitudinal edges of the upper slab, while the transverse ends of the lower slab are preferably parallel to the corresponding transverse ends of the upper slab. It should furthermore be noted that all of the plates 2 of the outer ring "A" are identical in shape to the plates 3 of the next inner ring "B" and differ only therefrom in that the length dimensions of the plates of the outer ring "A" are greater than the corresponding length dimensions of the plates of the inner ring "B". If additional inner rings are desired, then the plates of each such additional ring would be progressively shorter and shorter compared to those of the outer ring, as respects the length dimension. If desired, width dimension of the slabs may be varied from ring to ring.

As will be seen in FIG. 4, the protruding ends 14 and 15 and the edge 16 of the upper flat slab 13 form an upper lip framing the ends 24, 25 and the edge of 26 of the lower slab, such upper lip extending beyond the corresponding portions of the lower slab, while the protruding longitudinal edge 27 of the lower slab 23 forms a lower lip extending beyond the corresponding longitudinal edge 17 of the upper slab 13.

In assembled condition of the structure (FIG. 2), the lower edge lip 27′ extends toward the center of the stratum 1. The upper end lip 14′ of outer ring plate 2*a* is supported by the lower longitudinal edge lip 27*b*′ of the next succeeding (in clockwise direction) outer plate 2*b*, and so on around the outer ring "A". Each such outer plate element 2*a*, 2*b*, 2*c*, 2*d*, is thus supported solely at one end by its associated vertical column 5*a*, 5*b*, 5*c*, 5*d*, and at the other end by the lower longitudinal edge lip 27*a*′, 27*b*′, 27*c*′, 27*d*′*to* of the next succeeding plate element in ring "A".

Since the plates 2 are identical in shape and construction (except for length dimensions) to the plate 3a, already described, a further description of the former is not believed necessary.

Figure 2:
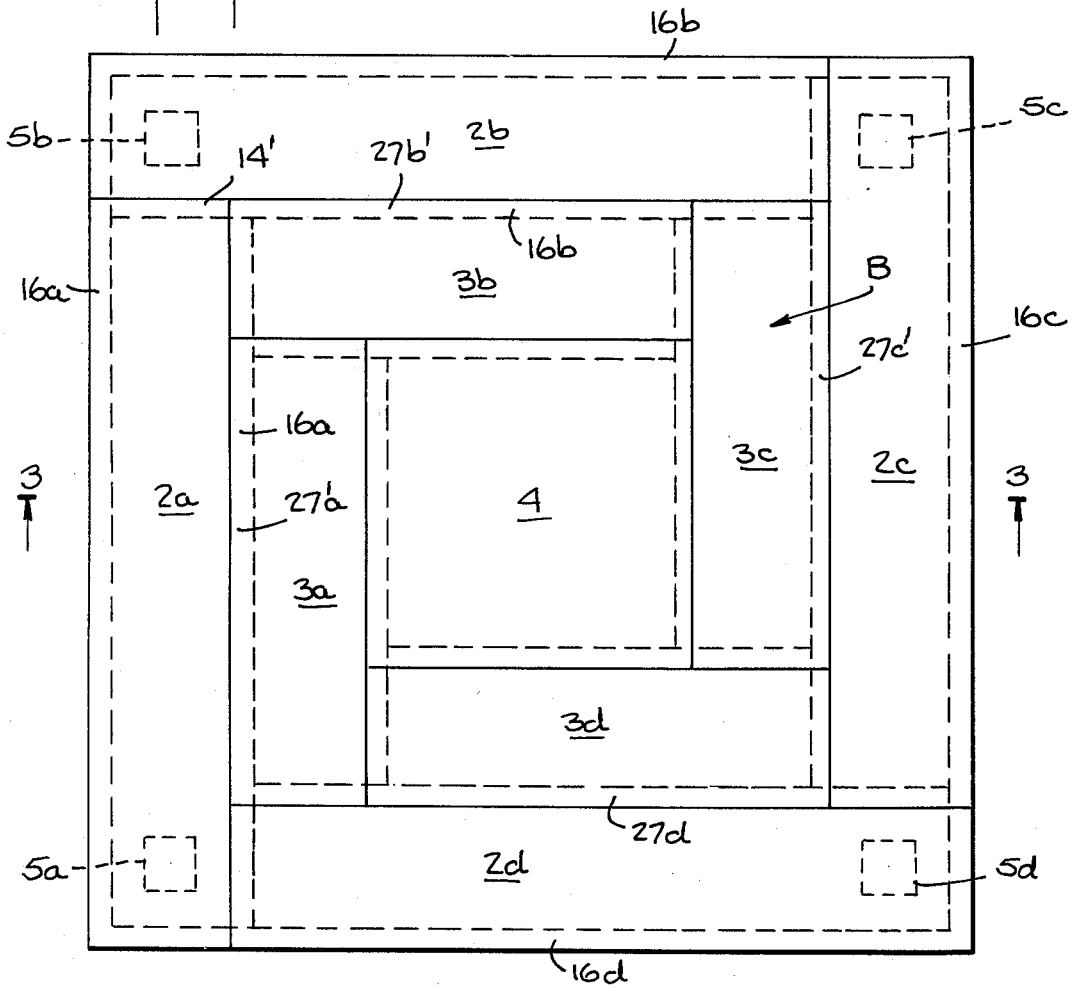
FIG. 2 is a top plan view of the floor structure illustrated in FIG. 1, showing in greater detail the supporting lips of the individual plate members.

The structure so far described, namely, outer ring "A", leaves uncovered a central rectangular aperture "X" (FIG. 4), and to partially close this aperture "X", there is provided an additional ring "B" of plates inwardly of ring "A". Ring "B" is comprised of four additional plate elements 3a, 3b, 3c and 3d, identical to each other and in all respects except for length dimension, identical to the plates 2 described above. As seen in FIG. 2, the inner ring "B" formed by the plates 3*a*, 3*b*, etc., displays along its entire periphery an upper protruding edge lip comprised of lips 16*a*, 16*b*, 16*c* and 16*d*, which in turn are seated in and supported by the lower inwardly projecting edge lips 27*a*′, 27*b*′, 27*c*′ and 27*d*′ of the plates 2 of the outer ring "A". Thus, instead of being supported by vertical columns, the inner ring "B" is supported along its entire periphery solely by the outer ring "A". It will be seen that the individual plate members 3 forming the inner ring "B" also support one another in the manner already described with respect to ring "A", namely, an upper end lip 14 of each of the plates 3 is supported on the inwardly facing lower edge lip 27 of the next succeeding plate 3 and so on around inner ring "B".

Figure 6:
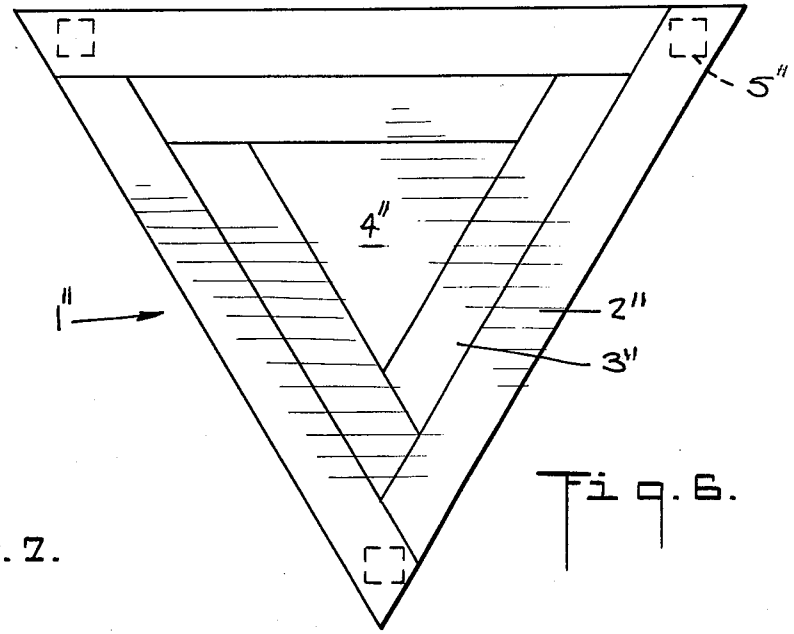
FIG. 6 is a top plan view of a structure according to a still further embodiment of the present invention.
Figure 5:
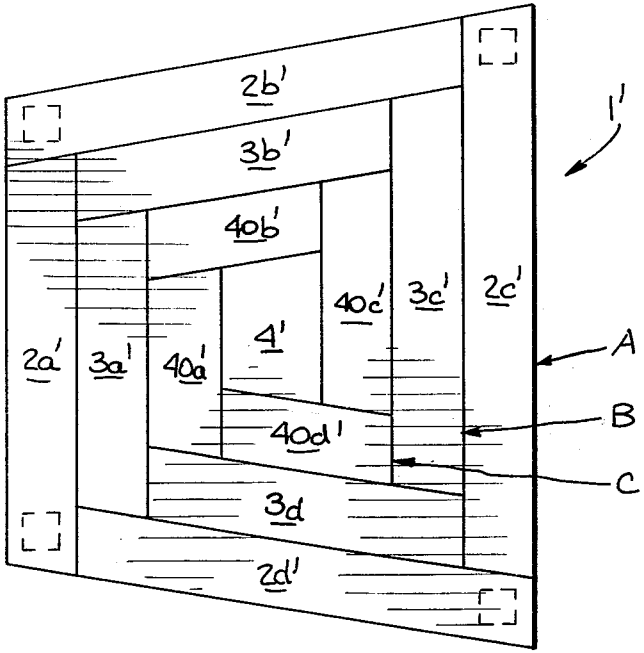
FIG. 5 is a top plan view of a structure according to another embodiment of the present invention.

It will be noted that by appropriately varying the shape of the individual plate members, the shape of the "rings" formed by the plate members may be varied. In FIG. 5, for example, is shown another polygonal stratum 1′, while in FIG. 6, a similar structure may be formed with a triangular shaped stratum 1'' by merely varying still further the shape of the individual plate members. In FIG. 6 there is illustrated a structure comprised of trapezoidal plates 2'' and 3'' and a triangular slab 4''. In each case, however, the structural relationship between the plate members and between the "rings" formed therewith, remains the same in accordance with the present invention. The structure illustrated in FIG. 5 also has an additional inner ring "C" of plates 40*a'*, 40*b'*, 40*c'* and 40*d'*, intermediate inner ring "B" and central slab 4'.

Turning once again to the embodiment shown in FIG. 1, it will be noted that the surface structure 1 provided after assembly of the second ring "B" of plates 3 still leaves uncovered a portion "Y" of the rectangular aperture "X". To close this remaining aperture and to further improve the load carrying capacity of the surface stratum, there is provided a rectangular central slab member 4 (FIG. 4). The slab 4 is preferably square in shape and has upper edge lips 4*a*, 4*b*, 4*c* and 4*d* extending along each of its four sides, respectively. To close the aperture "Y", the slab 4 is positioned therein so that the upper edge lips 4*a*, 4*b*, 4*c* and 4*d* of the slab are supported by the corresponding lower edge lips 27 of the adjacent interior plates 3 forming the ring "B".

The floor structure according to the invention has good load bearing capabilities considering particularly its large self-supported surface area made up of a plurality of rings of interfitting modular elements or plates. The foregoing advantageous results stem from the fact that each of the plates is supported, if not directly, then at least indirectly, by each of the other plates in the structure. Thus, a load applied to any one of the plates will be distributed over all of the plate members so that excessive loading of any one plate member is avoided.

At this point, it is appropriate to note that although the stratum 1 has been illustrated as having a rectangular, triangular or trapezoidal configuration, the instant invention may appropriately be utilized in any polygonal configuration, that it, any configuration having three or more sides. It is not even necessary that the polygon have equal opposing sides, but rather, while such structure may not be the preferred one, all four sides may be unequal. Finally, the floor structure 1 may comprise as many rings, A, B, C, etc., as desired. Each additional ring could be formed in the same manner as and would cooperate with the other rings precisely in the same manner as the rings "A" and "B", already described.

It will now be clear that the utilization of the instant invention will provide a number of advantages. For example, if the stratum 1 is configurated as an equilateral polygon, although, as previously noted, this is not necessary, then all the peripheral plates 2 will be identical to one another and all the interior plates 3 will be identical to one another, thereby allowing for the efficiencies of mass production. It will also be seen that regardless of whether the stratum 1 is an equilateral polygon shape or not, each of the individual plate members may be manufactured, i.e. prefabricated, in a factory, thereby obviating the need to manufacture them at the building site. The prefabricated plates may then be shipped by rail or truck to the building site in completed form and ready for assembly to one another.

Since the plates 2, 3 and 4 have to resist substantial loading due both to their own weight and to the load borne by the floor, their reinforcement is important and should preferably consist of steel reinforcing bars passing in two perpendicular directions, horizontally there through. These reinforcing bars preferably extend in the regions of both the upper and lower surfaces of the plates so as to reinforce also the upper and lower edge and end lips.

Both the top as well as the undersides of the plates can provide completely flat surfaces, so that the floors formed by the interfitting plates (lip-to-lip) have level upper and under faces.

As shown in FIGS. 1 and 2, the floor 1 is supported on a group of four vertical columns 5 which are disposed at the corners of an imaginary square. Each column 5 directly supports one end of one of the rectangular plates, the other end of which extends toward, but does not quite reach, the next adjacent column 5 (when viewed in one direction — in this case clockwise). Each of the plates 2, 3, 4, is rectangular in plan and is preferably precast out of concrete.

The plates 2 which define the boundaries of the floor 1 (FIG. 3) may, if desired, be of special construction (not illustrated) in that they need not be provided with the outwardly extending lips 16, since such lips would serve no useful purpose at the periphery of the structure.

The gaps between the plates (i.e. between the individual plates forming the rings "A" and "B" and between the rings "A" and "B" themselves, as well as between plate 4 and the ring "B",) may be filled in with grout, which may be of quick setting cement, so as to render the floor substantially monolithic.

It will be obvious to those skilled in the art that while only a single floor structure has been described herein, multi-floor structures may be conveniently constructed in accordance with the present invention by merely providing, in a well known manner, additional vertical columns above those shown herein, and constructing thereon one or more additional floors as herein described.

Figure 7:
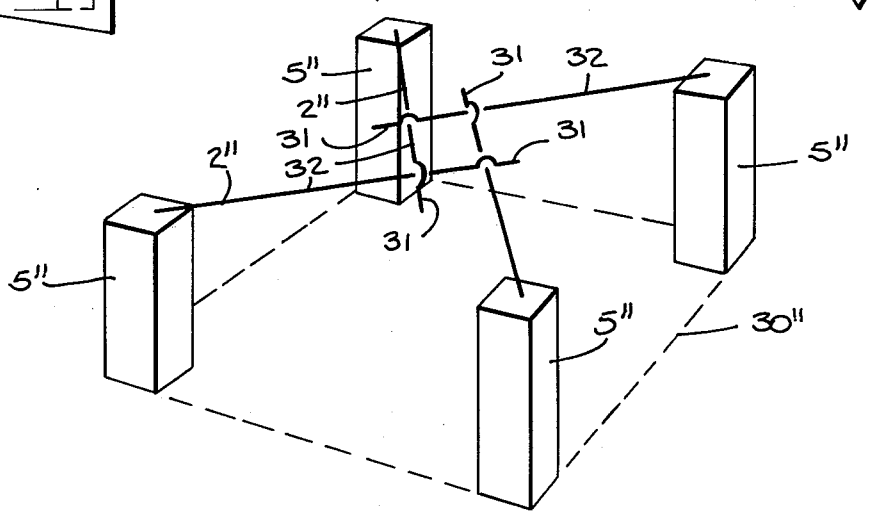
FIG. 7 is a perspective, schematic illustration of still another embodiment of the present invention.

In the embodiment illustrated in FIG. 7, the floor plates are represented schematically by line 32.

Each of the plates 2'' extends from its respective support column 5'' toward the interior of the imaginary rectangle 30'' (delineated by the columns 5'',) and rests with its free end 31 on an intermediate portion 32 of the next succeeding one of the plate members 2'' (when viewed in one direction around the imaginary rectangle, and not in the other direction).

Since each of the plates 2'' plays a role in supporting each of the other plates 2'', a load on any one of the plates is therefore distributed among all of the latter.

At the building site, after the vertical support columns 5 have been constructed and/or positioned as desired, the individaul plates 2 of the outer ring "A" are lifted into position one by one, each such plate having its free end temporarily supported by a lifting apparatus (crane, jack, etc.) until the next succeeding plate 2 is also in proper position. Thereafter, the lifting apparatus is operated to lower the free end onto the next succeeding plate so that the plates 2 support one another around the ring "A" and are in turn supported as previously described by the vertical columns 5. The plates 3 forming the next inner ring "B" are then lifted into position one by one until the ring "B" is completed. During such construction, the end 14 of each plate 3 is temporarily elevated until the lip 27 of the next succeeding plate 3 is positioned thereunder. Grouting and other connecting means may, but need not, be provided between the supporting and supported plate portions. If desired, conventional connecting means and materials may be used.

It will be noted that compared to the overall surface 1 formed by the plates 2, 3 and 4, the size of each individual plate 2, 3 and 4 is relatively small, thus providing for ease and simplicity of transportation from the factory to the building site.

Also, the parts illustrated in FIGS. 2, 3, 4, 5 and 6 correspond to those illustrated in FIG. 1, and are indicated by corresponding numerals. The individual plate members 2, 3, 4, etc., may be formed of any suitable material, however, in the preferred form of the invention, the plates 2, 3 and 4 are each preferrably formed of reinforced concrete.

Each of these plates, it will be remembered, acts as a load carrying member, and in combination with all of the other plates in the structure forms a self-supporting floor or stratum.

The plates 2 forming the outer ring "A" may be connected to the vertical columns 5 in the following manner:

The plates 2, preferably formed of concrete, preferably have imbedded in them small steel plates (not shown) located at the lower surfaces of plates 2 in the regions where the vertical columns 5 below will bear on the plates 2. In the case of a multi story structure, additional small steel plates (not shown) may be imbedded at the upper surface of the plate 2. Also, each of the columns 5 above (in the case of a multi story structure) and below shall have a similar steel plate imbedded in the ends of the columns placed such that an imbedded steel plate in each of the columns 5 will bear against a corresponding steel plate in the plate 2 supporting, or supported on, as the case may be, the respective column 5. The pairs of abutting steel plates, on the column and on the plate 2, can then be welded together to form an integral structural load-resisting unit.

As used herein, the term "floor" or "floor structure" is intended to encompass in addition to a floor, also all other structures and stratum forms supported at a given elevation such as, for example, a roof structure.

It will be understood that the foregoing description of the preferred embodiment of the present invention is for purposes of illustration only and that the various structural and operational features as herein disclosed are susceptible to a number of modifications and changes, none of which entail any departure from the spirit and scope of the present invention as defined in the hereto appended claims.

What is claimed is:

1. A beamless floor structure comprising a plurality of elongated plate members cooperating to form a closed ring means, each of said plate members having an end portion supported by a longitudinal edge portion of the next succeeding one of said plate members and having a longitudinal edge portion supporting an end portion of the next preceding one of said plate members when viewed in one direction around said closed ring and not in the other, and a plurality of support means equal in number to said plate members and cooperating with said plate members for supporting said ring means at a given elevation, each of said plate members having a second end portion supported by a corresponding one of said support means and having an unsupported portion intermediate said end portions thereof.

2. A floor structure according to claim 1 further comprising additional elongated plate members forming an additional ring means located inwardly of said first mentioned ring means, each of said additional plate members having an end portion supported by an edge portion of the next succeeding one of said additional plate members, and having an edge portion supporting an end portion of the preceding one of said additional plate members when viewed in one direction around said additional ring means and not in the other, said additional ring means being supported solely by said first mentioned outer ring means.

3. A floor structure according to claim 2 wherein each of said additional plate members comprises a second end portion spaced from said first mentioned end portion, each of said end portions comprising an upper transversely extending end lip and said edge portion comprising a longitudinal lower edge lip, and said plate member having along the other longitudinal edge thereof, an upper edge lip, said pair of upper end lips together with said one upper edge lip framing the corresponding opposite ends and intermediate edge of the plate member, and

4. The floor structure according to claim 2 further comprising a central plate means having a dimension and shape suitable for covering the aperture defined by said additional ring means, said central plate means being adapted to be peripherally supported solely by said additional ring means.

5. The structure according to claim 2 wherein said plate members of said outer ring means are all identical to one another and wherein said plate members of said additional ring means are all identical to one another but shorter in length than the plate members of said outer ring means.

6. The beamless building floor according to claim 2, wherein the length of each said floor plate is such that it spans the distance between its respective support means and the facing edge portion of the next succeeding floor plate, when viewed in said one direction.

7. A floor structure according to claim 1 wherein said end portion of each of said plate members comprises a transverse upper end lip and said edge portion comprises a longitudinal lower edge lip, said edge lip being at a lower elevation than said end lip, said support means adapted to support said plate members only at the end portion thereof spaced from said first mentioned end portion, said upper end lips of said plate members being supported by the longitudinal lower edge lip of the next succeeding one of said plate members in the region of said second mentioned end portion thereof.

8. The floor structure according to claim 1 wherein each of said plate members comprises a laminate of an upper rectangular flat slab portion and a lower rectangular flat slab portion integrally connected with said upper slab portion, said upper slab portion extending at opposite longitudinal ends thereof beyond the corresponding ends of said lower slab portion and extending along one longitudinal edge thereof beyond the corresponding longitudinal edge of said lower slab portion; said lower slab portion extending along the other longitudinal edge thereof, beyond the corresponding other longitudinal edge of said upper slab portion.

9. The floor structure, according to claim 1, wherein said plate members are constructed of reinforced concrete.

10. The floor structure according to claim 1 wherein said support means comprises vertical support columns equal in number to the number of plate members in said closed ring means, each plate member being supported at its end portion, spaced from said first mentioned end portion, by a corresponding one of said support columns.

11. The beamless building floor according to claim 1, wherein each said floor plate is supported solely by its respective support means, on the one hand, and by the edge portion of the next succeeding one of said floor plates, on the other hand.

12. The beamless building floor according to claim 1, wherein said imaginary polygon is rectangular, said structure comprising four spaced support means, one located at each corner of said rectangle.

13. A beamless building floor comprising:

a plurality of spaced support means located respectively at the corners of an imaginary polygon;

a plurality of elongated floor plates equal in number to the spaced support means and each floor plate having a pair of spaced end portions and an elongated edge portion intermediate said end portions; and one of the end portions of each of said floor plates being supported on a different one of said support means and each said floor plates having its other end portion extending toward but not to the next succeeding support means when viewed in one direction, but not in the other, around said imaginary polygon, and having its said other end portion supported on the edge portion of the floor plate extending from said next succeeding support means and said floor plates together forming a polygonally-shaped flooring having a central opening.

14. A beamless building floor comprising:

a plurality of spaced support means located respectively at the corners of an imaginary polygon;

a plurality of elongated floor plates each having an intermediate portion and a pair of spaced end portions;

one of the end portions of each of said plates being supported solely on a respective one of said support means and each of said plates extending from its respective support means into the interior of said imaginary polygon and having the other of its end portions supported solely on the intermediate portion of the next adjacent plate extending from the next adjacent succeeding support means, when viewed in a given direction around said polygon, and not in the other direction, said plates together forming a closed figure having a central opening.

15. A beamless floor structure comprising: a plurality of elongated plate members cooperating to form a closed ring means, each of said plate members having an end portion supported solely by a longitudinal edge portion of the next succeeding one of said plate members and having a longitudinal edge portion providing the sole support for an end portion of the next preceding one of said plate members when viewed in one direction around said closed ring and not in the other, and a plurality of support means equal in number to said plate members and cooperating with said plate members for supporting said ring means at a given elevation each of said plate members having a second end portion supported solely by a corresponding one of said support means.

16. A beamless floor structure comprising: a closed outer ring means, support means cooperating with said outer ring means for supporting said outer ring means at a given elevation, elongated plate members forming an additional ring means located inwardly of said outer ring means, each of said plate members having a longitudinal end portion supported by an edge portion of the next succeeding one of said plate members and having an edge portion supporting an end portion of a preceding one of said plate members when viewed in one direction around said additional ring means and not in the other, said additional ring means being supported solely by said outer ring means.

* * * * *